United States Patent [19]

McVeigh

[11] Patent Number: 4,854,736

[45] Date of Patent: Aug. 8, 1989

[54] INSULATED CARRY BAG

[76] Inventor: Martin L. McVeigh, "Wyuna", 51 Woods Street, Manly 2095, New South Wales, Australia

[21] Appl. No.: 191,148

[22] PCT Filed: Jul. 1, 1987

[86] PCT No.: PCT/AU87/00193

§ 371 Date: Feb. 18, 1988

§ 102(e) Date: Feb. 18, 1988

[87] PCT Pub. No.: WO88/00160

PCT Pub. Date: Jan. 14, 1988

[30] Foreign Application Priority Data

Jul. 2, 1986 [AU] Australia ..... PH6697

[51] Int. Cl.[4] ..... B65D 30/08; B65D 81/38

[52] U.S. Cl. ..... 383/76; 62/530; 383/110

[58] Field of Search ..... 383/110, 76; 62/371, 62/372, 457, 530; 206/584

[56] References Cited

U.S. PATENT DOCUMENTS

| | | | |
|---|---|---|---|
| 1,942,917 | 1/1934 | D'Este et al. | 383/110 |
| 1,993,394 | 3/1935 | Bangs et al. | 383/110 |
| 2,216,330 | 10/1940 | Stover | 62/372 |
| 2,667,198 | 1/1954 | Klein | 383/110 |
| 2,857,949 | 10/1958 | Ziff | 383/110 |
| 2,960,136 | 11/1960 | Ziff | 383/110 |
| 3,066,847 | 12/1962 | Fortune | 62/530 |
| 3,358,059 | 12/1967 | Snyder | 264/51 |
| 3,595,464 | 7/1971 | Harrison | 229/1.5 B |
| 4,211,091 | 7/1980 | Campbell | 62/372 |
| 4,343,158 | 8/1982 | Campbell | 62/372 |

FOREIGN PATENT DOCUMENTS

| | | | |
|---|---|---|---|
| 198908 | 8/1950 | Fed. Rep. of Germany | 383/110 |
| 3231297 | 2/1984 | Fed. Rep. of Germany | 383/110 |
| 1153034 | 2/1958 | France | 383/110 |
| 2587302 | 3/1987 | France | 383/110 |

*Primary Examiner*—Stephen P. Garbe

*Attorney, Agent, or Firm*—Louis Weinstein

[57] ABSTRACT

An insulated carry bag comprising an inner liner bag (2) within an outer cover bag (1) with the open ends of the bags joined to form a neck (3) with neck closure means (5, 6). There is filling a particulate thermally insulating material (4) between the inner and outer bags (1, 2). The inner and outer bags (1, 2) are made of flexible sheet material allowing the carry bag to adopt the shape of an article housed therein and the sheet material and the particulate material (4) are capable of maintaining a static electrical surface charge sufficient to cause the material (4) to adhere to the surfaces of the inner and/or outer bags (1, 2).

4 Claims, 2 Drawing Sheets

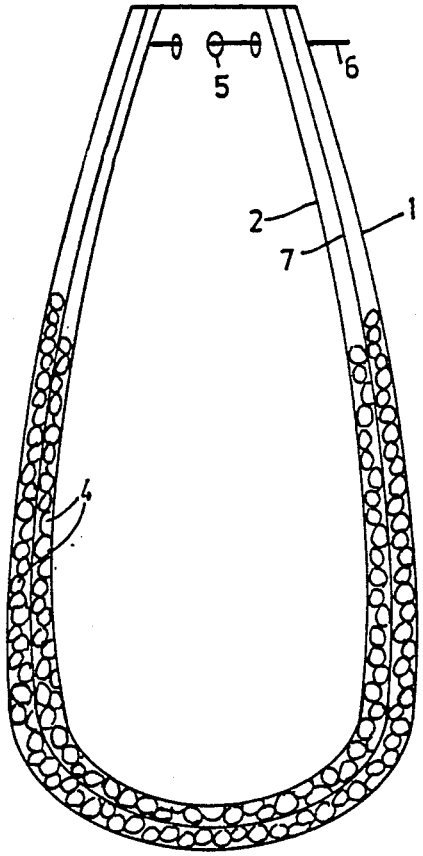
FIG. 5.
FIG. 6.
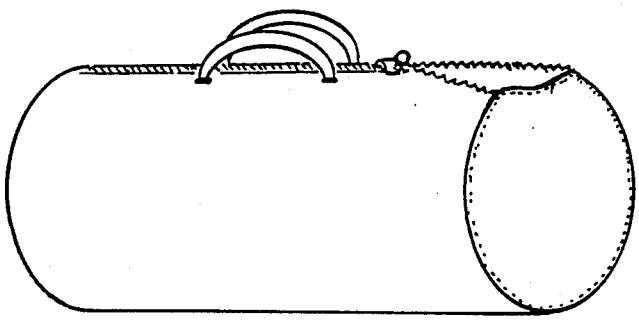

INSULATED CARRY BAG

This invention relates to carry bags to transport and maintain goods which are initially above or below ambient temperature at or close to their initial temperature.

In the past one form of insulated container for the above purpose has had a rigid physical form and the heated or chilled goods to be transported have been placed in the container and a closure has been applied to isolate the atmosphere within the container from outside atmospheric conditions. After the closure of the container there is an averaging-out heat exchange between the goods and the space not occupied by the goods to provide a temperature within the container different to that of the outside air and the initial temperature of the goods.

In another form of insulated container, which is general of a "bag" form, flexible but semi-rigid sides of the bag are interconnected by hinge folds allowing the bag to expand to accept large objects and contract to a smaller size for smaller objects. There is however still a large amount of unoccupied space within the container when goods are located therein and the closure of the container is applied. Again there is an averaging-out of the temperature of the atmosphere within the container and the goods within the container after the closure thereof.

This invention has as its object the provision of a bag which will substantially completed embrace goods housed within it and so minimise the amount of air within the bag. As there is very little air in the bag there will be a minimal heat loss or heat gain to the air in the bag and this ensures that the atmospheric temperature within the bag will closely approximate that of the goods located therein.

The carry bag as proposed comprises generally an inner bag and an outer with insulating means therebetween. The inner and outer bags are made from soft material. The term soft material as used herein means a flexible sheet material with substantially no body rigidity which can be formed into a bag able to adopt any configuration within the limits determined by its physical shape and size. Soft materials as hereinbefore defined are preferably selected from the group comprising woven or non-woven fabric sheet materials and sheet plastics material. Preferably also the inner bag material is waterproof.

Broadly, the present invention can be said to comprise an insulated carry bag including an outer bag part made of soft material (as hereinbefore defined) with an opening therein, and an inner bag part made of soft material (as hereinbefore defined) with an opening therein, the perimeters of the openings in the inner and outer bags are joined to provide a mouth for the carry bag and closure means for the mouth is provided whereby the mouth of the carry bag can be substantially closed to isolate the interior of the inner bag part from atmosphere, and a plurality of particles of thermally insulating material between the inner and outer wall parts of the carry bag.

Two presently preferred forms of the invention will now be described with reference to the accompanying drawings in which:

FIG. 5 is a view similar to FIG. 3 of an alternate construction, and

FIG. 6 is a perspective view of a second form of the invention.

Figure 1:
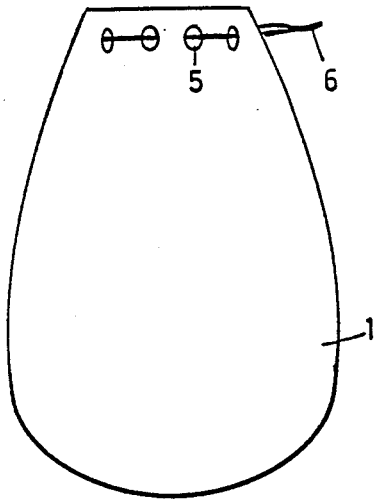
FIG. 1 is a perspective view of the carry bag in a mouth closed configuration.
Figure 2:
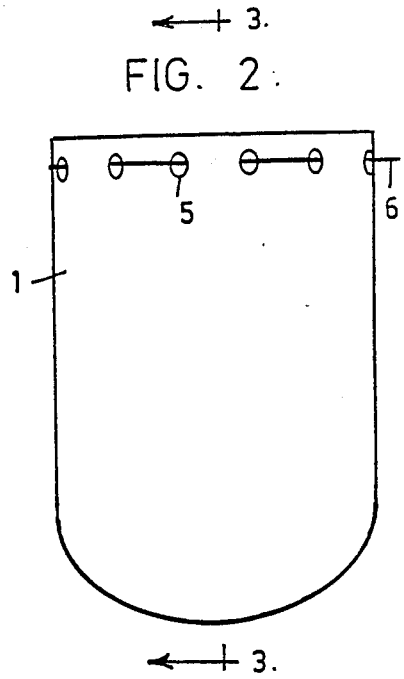
FIG. 2 is a perspective view in a mouth open configuration.

Referring to the drawings the carry bag comprises an outer bag 1 made of a soft material as hereinbefore defined and in the present example is made from plastic coated woven fabric with sewn joints, although welded or heat sealed joints can be used. Inside the outer bag 1 there is an inner bag 2 made of soft material as hereinbefore defined and in the present example is made of laminated polyethylene sheet material again with sewn joints although welded or heat sealed joints can be used. The inner bag 2 preferably has a capacity when opened up which is less than that of the inner bag 1 as can be readily seen from FIG. 3. The inner and outer bags have openings therein and the peripheries of the openings are fastened together, as by sewing or adhesive, to form a mouth 3 for the carry bag. The bag materials may have a limited degree of elastic stretch to facilitate accommodation of irregularly shaped objects placed within the carry bag.

There are eyelets 5 around the upper end of the carry bag adjacent the mouth thereof. A draw string 6 is provided whereby the mouth of the carry bag can be closed to retain an object housed within the carry bag or about portion of an object protruding through the mouth of the carry bag, as for example the neck of a bottle.

Figure 3:
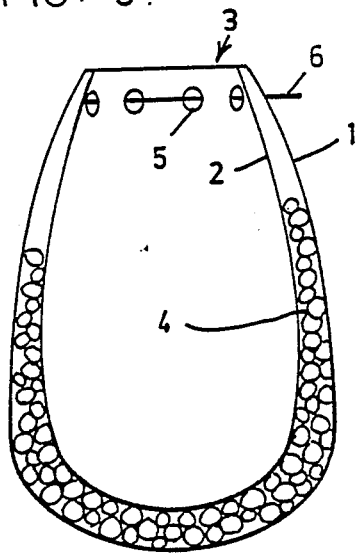
FIG. 3 is a sectional elevation on the section line 3—3 of FIG. 2.
Figure 4:
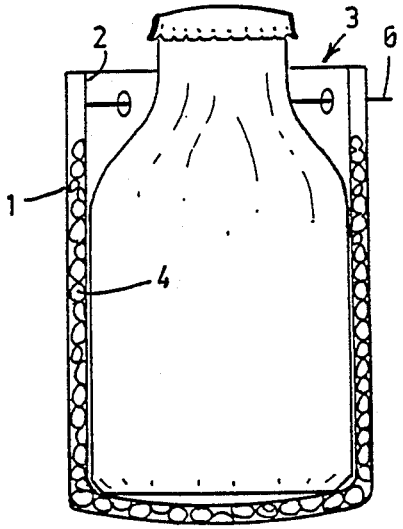
FIG. 4 is a view similar to FIG. 3 with a bottle housed in the carry bag.

Housed between the inner and outer bags there is insulation material in the form of pellets 4. The pellets 4 are preferably of random diameter within a predetermined range and are made of foamed polystyrene. The pellets may however be formed of other materials such as crumbled or granulated foam plastics material having the qualities of foamed polystyrene pellets as are hereinafter set out. The number of pellets 4 should be such that there is a least sufficient to provide a single skin of pellets about substantially all of the exterior of the inner bag when an object is housed in the carry bag. In FIG. 3 it will be seen that there will be a natural tendency for the pellets to migrate to the bottom section of the carry bag when unoccupied. FIG. 4 indicates how a pellet redistribution will take place when an object is positioned in the carry bag. The redistribution can be likened to a fluid flow of the pellets which will migrate from a zone where pressure is exerted to a zone of lesser pressure.

FIG. 5 illustrates an alternate arrangement where there is an intermediate bag identified 7 with the open ends of the bags 1,2 and 7 fixed together to form the carry bag mouth 3. The bag 7 has several uses. For example, it can be used to separate two zones occupied by pellets 4 thereby providing additional insulation for the carry bag whilst controlling the location of the pellets in two "skins" around the object within the carry bag. The bag 7 need not be made of any particular material, for example it need not be waterproof. It can be in the form of a net which is strong and have openings small enough to prevent pellets migrating from one skin to the other. The bag 7 may be made of inextensible strong material or net and provide the strength of the carry bag and relieve the inner and outer bags of the stretching forces that will occur if a heavy object is transported in the carry bag and it is supported by the draw string 6. With such an arrangement the inner and outer bags could be relatively thin and decorative light weight material could be used for the outer bag and waterproof light weight material could be used for the inner bag.

In an alternate arrangement the inner and/or outer bags may have reinforcement strips affixed thereto to provide load support for objects carried in the carry bag thereby substantially eliminating tension loads on the inner and/or outer bags. The intermediate bag 7 may also be in the form of a large mesh or grid which will allow free migration of the pellets between the inner and outer bags.

Preferably the material from which the inner and outer bags is made is such as to have an electrostatic affinity with the pellets 4, as may be promoted simply by frictional contact between polystyrene pellets and the inner and outer bags. The electrostatic attraction between the pellets and the material from which the inner and outer bags is made promotes the formation of a layer of pellets on the outer surface of the inner bag.

As will be understood the form of the carry bag substantially eliminates unoccupied air space within the carry bag and so there is little heat exchange between an object in the carry bag and the atmosphere within the carry bag. This is promoted by the support of the carry bag and contents by the draw string 6. The result is improved temperature retention for the object in the carry bag.

Where an object or a number of objects are inserted into the carry bag assembly, e.g. a bottle of wine, or several cans of beer, or an irregular object such as a box or packet is and the closed bag assembly is left lying on a surface the natural tendency is for the bag assembly to slump, due to the flexible nature of the bag materials. This also substantially eliminates empty space from within the bag assembly with resultant efficient temperature retention by the object(s) within the carry bag.

With irregular or regular shaped objects the placement of the object within the bag assembly will cause the flow of pellets between the bags. For example, if a bag assembly is lying on a table a majority of the pellets surplus to those electrostatically adhering to the inner bag will probably be in the lowermost portion of the bag assembly. By placing a bottle in the bag assembly the weight of the bottle and the natural shuffling of the pellets as the bottle in positioned within the carry bag will result in a generally uniform distribution of the pellets around the bottle as the pellets flow freely between the bags. The distribution of the pellets into a moulded consolidated sleeve around the bottle is further promoted by the application of tightening pressure to the drawstring provided as part of the carry bag.

In another example, if an object was thrust into a bag assembly sitting on its closed end, with the majority of the pellets not electrostatically adhering to the inner bag gathered at the closed end, the action of thrusting the object into the bag and the gravitational effect on the object will cause the pellets to flow upwardly over each other to form a skin several pellets thick around the object. The capacity of the pellets to flow between the bags and so allow the bag to adapt to accommodate objects of differing shapes and sizes provides an advantage over known containers for the defined purpose.

The foregoing example can be varied as shown in FIG. 6 to have a different shape to that of the example illustrated in FIGS. 1 to 5 whilst having the same physical characteristics.

I claim:

1. An insulated carry bag with substantially no resistance to manual reformation from a substantially cylindrical shape which is the normal expanded configuration of the carry bag to a shape corresponding to that of an article or an aggregation of articles housed in the carry bag, said carry bag comprising an outer bag part made of flexible sheet material and of generally cylindrical shape when expanded and which is closed at one end and open at the other end, an inner bag part of generally cylindrical shape when expanded and which is closed at one end and open at the other end, the inner bag part being smaller in diameter and shorter in length than the outer bag part and the perimeters of the open ends of the inner and outer bag parts being joined to form a mouth for the carry bag and the only connection between the outer and inner bag parts, drawstring closure, thermal insulating material in particulate form being provided in the hollow region defined by the outer bag part and inner bag part, the quantity of said particulate being at least sufficient to form a layer of insulation over the exterior surface of the inner bag part when it is expanded to cylindrical shape but less than the difference in volume of the region between the expanded form of the inner and outer bag parts.

2. A carry bag as claimed in claim 1 wherein the insulating material and at least the material from which the inner bag part is made are capable of maintaining a static electric surface charge sufficient to cause the insulating material to adhere to the inner bag part.

3. A carry bag as claimed in claim 1 wherein the insulating material is comprised of random sized spherical beads of foamed polystyrene.

4. A carry bag as claimed in claim 1 including an intermediate liner between the inner and outer bag parts, said liner having a shape similar to the inner and outer bag parts and being larger than the inner bag part and smaller than the outer bag part and having an open end secured to the open ends of the inner and outer bag parts;

said insulation material being disposed between the inner and intermediate bag parts and between the intermediate and outer bag parts.

* * * * *